US006311349B1

(12) United States Patent
Kazakia et al.

(10) Patent No.: US 6,311,349 B1
(45) Date of Patent: Nov. 6, 2001

(54) PELVIC POSITIONER

(75) Inventors: Galateia Kazakia; Steven Haas; Joseph Lipman; Bruce Robie, all of New York, NY (US)

(73) Assignee: New York Society for the Relief of the Ruptured and Crippled Maintaining the Hospital for Special Surgery, New York, NY (US)

( * ) Notice: Subject to any disclaimer, the term of this patent is extended or adjusted under 35 U.S.C. 154(b) by 0 days.

(21) Appl. No.: 09/320,607

(22) Filed: May 26, 1999

(51) Int. Cl.[7] ..... A47B 7/00

(52) U.S. Cl. ..... 5/624; 5/621; 5/648; 128/845; 128/846

(58) Field of Search ..... 5/624, 621, 630, 5/648; 128/846, 869, 877, 882, 845

(56) References Cited

U.S. PATENT DOCUMENTS

| | | | | |
|---|---|---|---|---|
| 2,306,031 | | 12/1942 | Anderson et al . | |
| 2,535,559 | | 12/1950 | Wolf . | |
| 2,678,857 | | 5/1954 | Hans . | |
| 3,669,118 | * | 6/1972 | Colon-Morales | 5/630 X |
| 3,823,709 | | 7/1974 | McGuire . | |
| 3,844,550 | | 10/1974 | McGuire . | |
| 3,873,081 | * | 3/1975 | Smith | 5/621 |
| 4,180,254 | * | 12/1979 | Lee et al. | 5/621 X |
| 4,526,355 | * | 7/1985 | Moore et al. | 5/624 |
| 4,583,725 | | 4/1986 | Arnold . | |
| 4,624,245 | | 11/1986 | Mullin et al. . | |
| 5,096,173 | * | 3/1992 | Yamashita et al. | 5/621 |
| 5,131,106 | * | 7/1992 | Jackson | 5/621 X |
| 5,324,247 | * | 6/1994 | Lepley | 482/134 |
| 5,390,383 | | 2/1995 | Carn . | |

OTHER PUBLICATIONS

Instructions for Montreal Lateral Positioning Device, Orthopedic Systems, Inc., 1997.

* cited by examiner

*Primary Examiner*—Lynne H. Browne
*Assistant Examiner*—James M Hewitt
(74) *Attorney, Agent, or Firm*—Darby & Darby

(57) ABSTRACT

A pelvic positioning device for stabilizing a patient while lying on their side in a lateral decubitus position. The device includes an anterior pelvic support mechanism including anterior support pads for contacting both pubic tubercles and the ASIS on one or both sides of the patient's body. In a preferred embodiment, the anterior pelvic support mechanism includes two ASIS pads. To provide additional stabilization an upper torso pad may be included proximate the sternum of the patient's rib cage. In addition, the device includes a posterior pelvic support mechanism including a telescopic vertical member and a crescent shaped posterior support pad. The posterior support pad is mounted by a collar to a free end of the telescopic vertical member so as to be freely rotatable in a horizontal plane parallel with the operating table. As the anterior and posterior pelvic support mechanisms are moved towards the patient's body, the posterior support pad freely rotates about the vertical member and automatically properly positions itself along the central line of the sacrum and terminating proximate the distal end of the coccyx.

19 Claims, 8 Drawing Sheets

PELVIC POSITIONER

FIELD OF THE INVENTION

The present invention relates generally to a positioning device for stabilizing a patient while lying on their side on a surgical table and, more particularly, to a midline pelvic positioner for stabilizing a patient during total hip replacement surgery.

DESCRIPTION OF THE PRIOR ART

During some types of surgical procedures, such as total hip replacement (THR) surgery, the patient is positioned lying on one side, referred to as the lateral decubitus position. While in the lateral decubitus position the patient's body is unstable and must be supported. Conventional pelvic positioners used to limit the motion of the patient's body during surgery while lying in the lateral decubitus position generally include vertical anterior and posterior pads that apply pressure to the pelvis. The anterior and posterior pads of these conventional devices contact the body in areas of varying soft tissue thickness, such as the abdomen and the buttocks, and stabilize motion of the pelvis by applying pressure to the overlying soft tissue. Although the body is constrained between the two pads, the pelvis is still subject to an undesirable degree of motion as a result of the resiliency of the soft tissue. Movement of the patient's body during THR surgery significantly increases the difficulty of accurately positioning of the acetabular components relative to the standing pelvic orientation.

SUMMARY OF THE INVENTION

An object of the invention is to provide an improved pelvic positioning device for precisely and repeatably orienting the position of the patient's body relative to the operating table.

Another object of the invention is to provide an improved pelvic position device that imparts greater pelvic stability during surgery so that the surgeon may exactly orient the acetabular components relative to the patient's pelvis by referencing the axes of the operating table.

The pelvic positioning device in accordance with the present invention is directed to a positioning device for supporting a patient's body in a lateral position on a table. In a preferred embodiment, the pelvic positioning device includes an anterior pelvic support mechanism including a first anterior support pad positioned so as to support both pubic tubercles of the patient's body; and a second anterior support pad positioned so as to support an anterior superior iliac spine on one side of the patient's body. The first and second anterior support pads are displaceable independently of one another and in three directions with each direction being substantially perpendicular to the others. Furthermore, the first anterior support pad is adapted so as to be separated by a distance from a pubic symphysis of the patient's body.

The positioning device also includes a crescent-shaped posterior support pad having a cephalad end and a caudad end. The posterior support pad is arranged so as that it extends along the sacrum of the patient's body with the caudad end terminating proximate a coccyx of the patient's body.

In addition, the invention is directed to a method for using the positioning device described above. Initially, a first anterior support pad is positioned so as to be proximate both pubic tubercles of the patient's body and a second anterior support pad is positioned independently of the first anterior support pad so as to be proximate an anterior superior iliac spine on one side of the patient's body.

To provide additional stability, a crescent-shaped posterior support pad having a cephalad end and a caudad end is positioned so that it extends along the patient's sacrum.

BRIEF DESCRIPTION OF THE DRAWINGS

The foregoing and other features of the present invention will be more readily apparent from the following detailed description and drawings of illustrative embodiments of the invention wherein like reference numbers refer to similar elements throughout the several views and in which.

DETAILED DESCRIPTION OF THE PREFERRED EMBODIMENT

For ease of explanation, terms such as anterior, posterior, horizontal, vertical, upper, lower, etc. are used with reference to the drawings. These terms are not intended to apply to the actual orientation of the party during use.

Figure 1A:
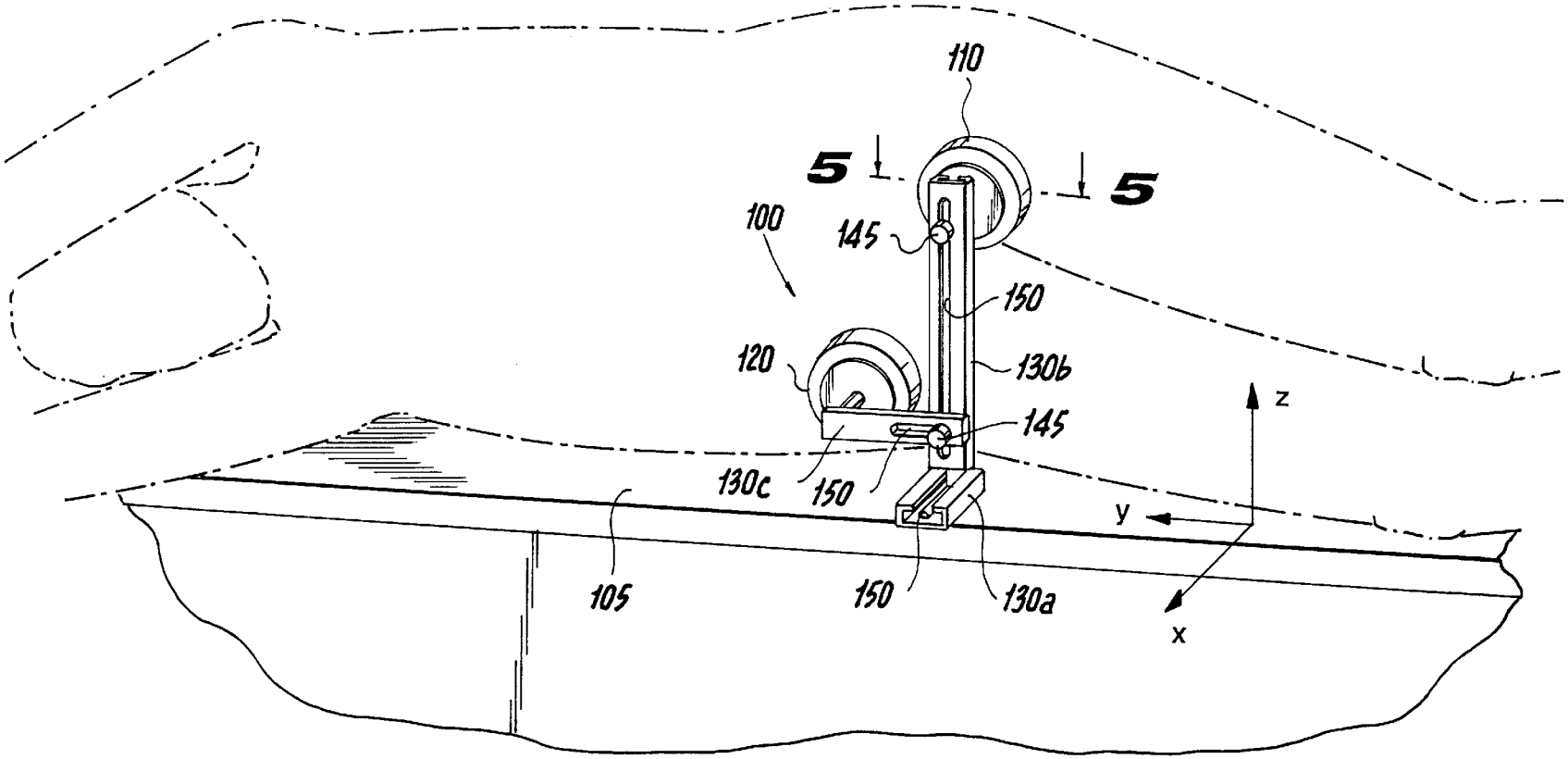
FIG. 1*a* is a front perspective view of a first embodiment of the anterior pelvic support mechanism of the pelvic positioning device in accordance with the present invention supporting a patient's body in a lateral decubitus position.
Figure 1B:
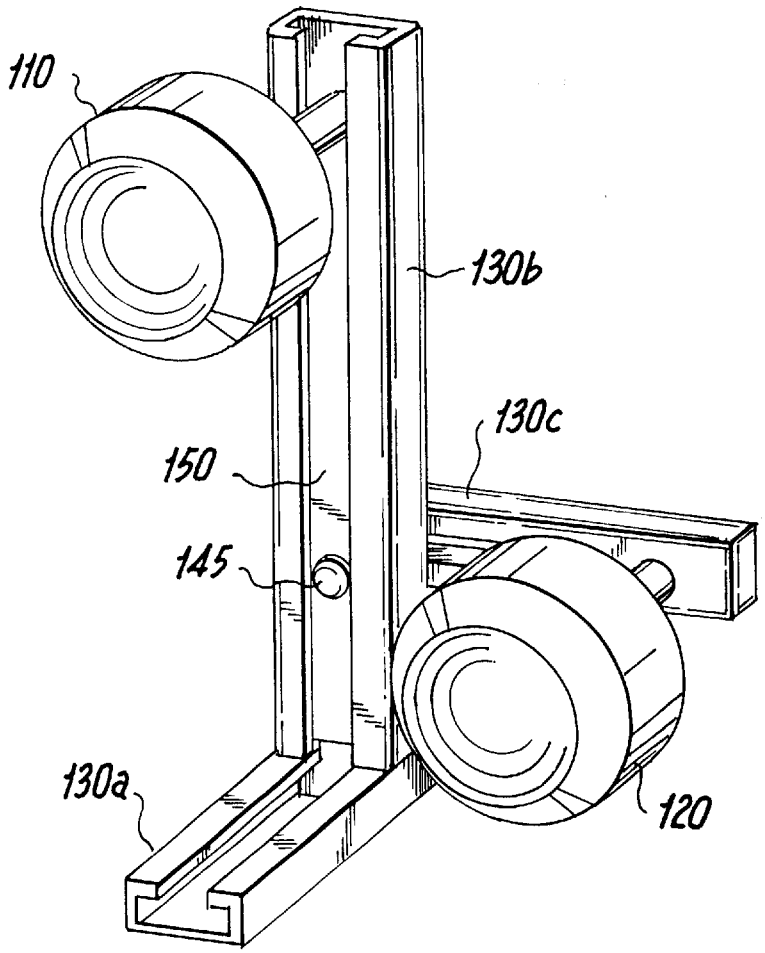
FIG. 1*b* is a front view of the front surface of the anterior pelvic support mechanism of FIG. 1*a* that contacts the patient's body.
Figure 5:
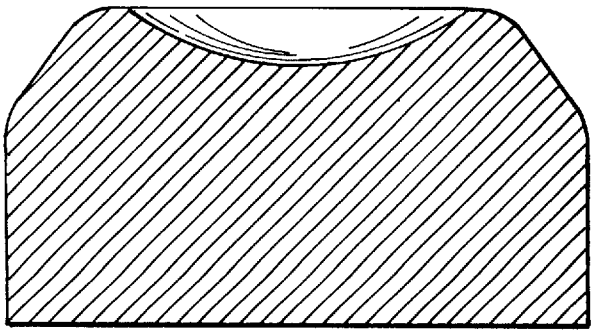
FIG. 5 is a cross sectional view of the anterior support pad along line IV—IV in FIG. 1*a;*
Figure 2:
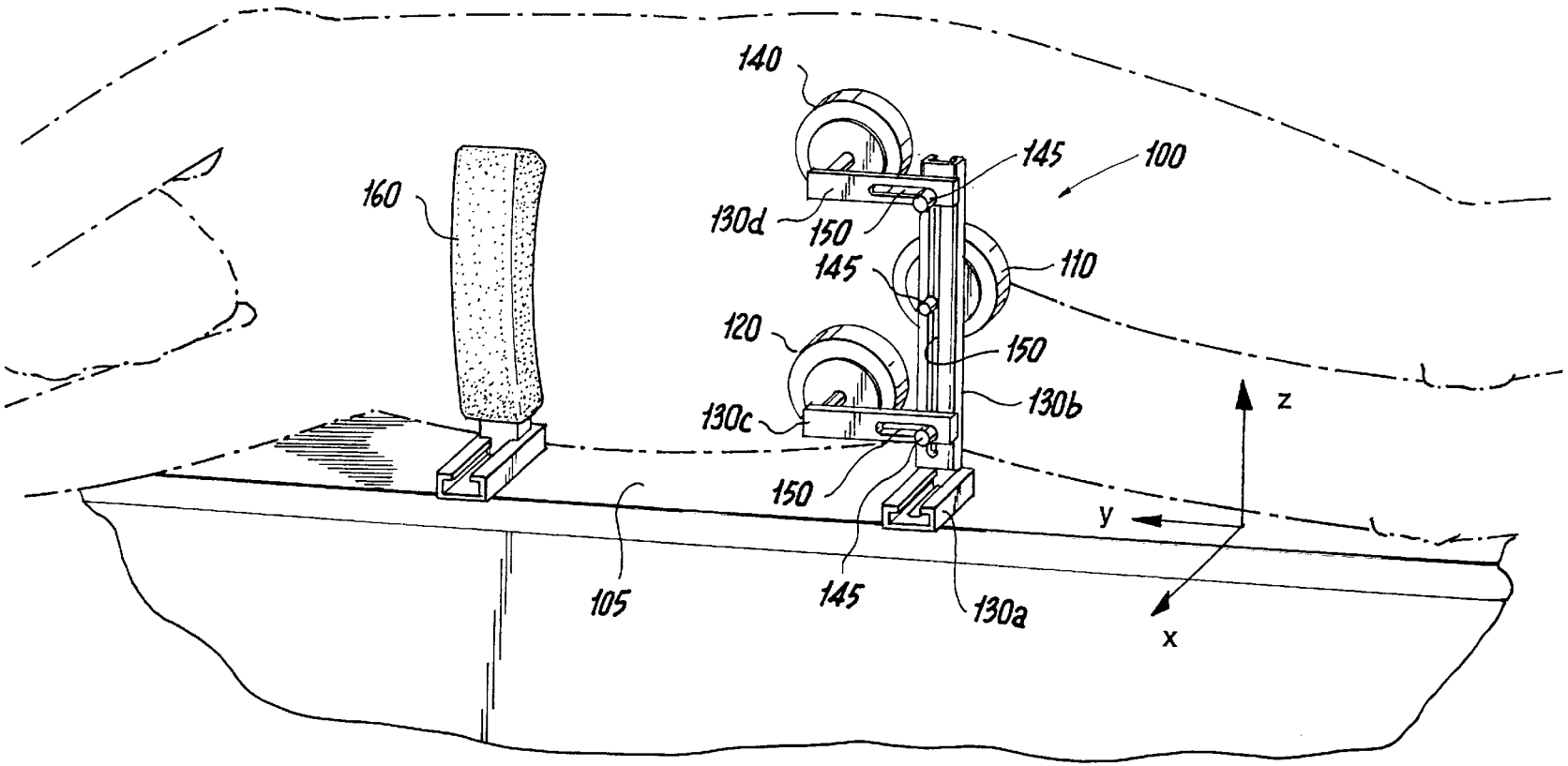
FIG. 2 is a front perspective view of a second embodiment of the anterior pelvic support mechanism of the pelvic positioning device in accordance with the present invention supporting a patient's body in a lateral decubitus position.

FIGS. 1*a* and 2 are different embodiments of the anterior support mechanism 100 of the pelvic positioning device in accordance with the present invention supporting a patient in the lateral decubitus position on an operating table 105. An operative side of the patient's body is a side of the patient's body to be operated on and farthest away from the operating table. In FIG. 1*a*, the patient is supported anteriorly by two pads 110, 120 that contact the body in a region of the pubic tubercles and anterior superior iliac spine (ASIS), respectively. In an alternative embodiment shown in FIG. 2, the anterior support mechanism 100 may include an additional pad 140 substantially aligned in a vertical direction relative to pad 120 that contacts the body in a region of the ASIS on the lower (non-operative) side of the patient's body relative to the operating table 105. Pad 140 provides additional support to the anterior of the pelvis thereby improving the overall stability of the patient. Conventional supporting pads, such as an upper torso pad 160 placed proximate the sternum of the patient's body, may also be used in conjunction with the anterior pelvic support mechanism in accordance with the present invention. In a preferred embodiment, each anterior pad 110, 120, 140 has a concave inner surface, as shown in the cross-sectional view in FIG. 5, in contact with one of the ASIS or both pubic tubercles, thereby further restricting movement of the patient's body. The concave inner surface is also advantageous in that it ensures that the support pad does not engage the pubic symphysis.

Anterior pelvic support mechanism 100 provides three-dimensional movement. Specifically, movement in the x-direction is realized via a C-shaped track 130*a* that is mounted to the operating table 105. A vertical member 130*b* has a T-shaped fixed end that is received in and displaceable along the track 130*a* in the x-direction. It should be noted that any complementary shaped displaceable tracking system may be used.

Pubic tubercle pad 110 is releasably secured directly to the vertical member 130*b* using a thumb screw 145. The two ASIS pads, 120, 140, however, are indirectly mounted to the vertical member 130*b* by way of horizontal members 130*c*, 130*d*, respectively. Each horizontal member 130*c*, 103*d* has a free end to which the pad is attached and an opposite end with an elongated slot 150 through which a thumb screw 145 is received to releasably secure the horizontal member to the vertical member 130*b*. By adjusting the thumb screws 145 the horizontal members 130*c*, 130*d* may be displaced independently of one another along the y-axis to properly position the pads in a region of one of the ASIS, preferably centered over the ASIS. The vertical height of the pads may be varied so that they contact the body in proper location, that is, on one of the ASIS or both pubic tubercles, by releasing the thumb screws and raising/lowering the pad 110 and/or horizontal arms 130*c*, 130*d*. Accordingly, the relative position of the anterior pelvic support pads may be adjusted in the multiple directions to allow for varying pelvic morphology in all patients.

Figure 3:
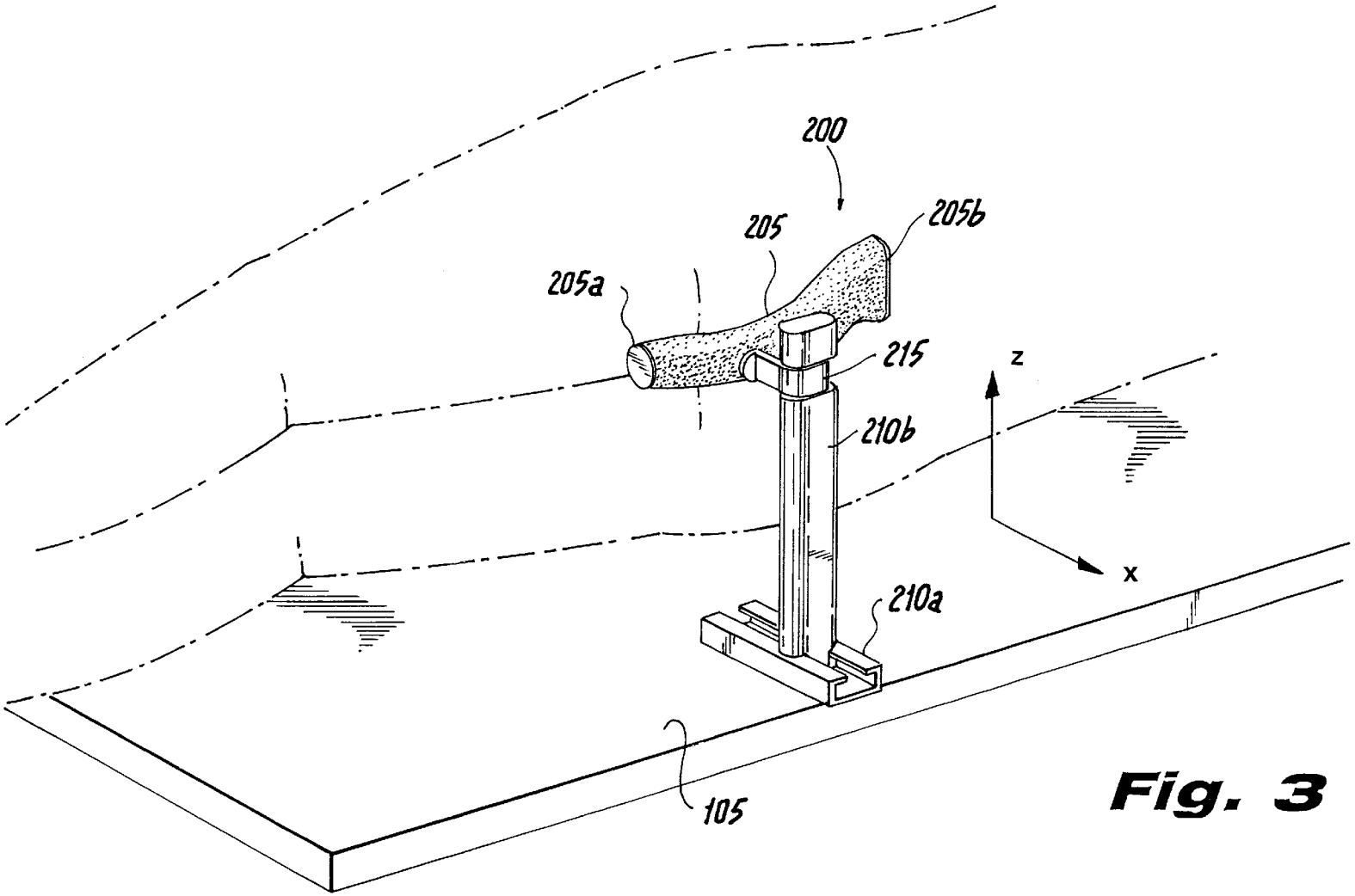
FIG. 3 is a back perspective view of the posterior pelvic support mechanism of the pelvic positioning device in accordance with the present invention.

As shown in FIG. 3, the posterior support mechanism 200 includes a posterior support pad 205 rotatably mounted to a free end of two or more telescopic tubes that form a vertical member 210*b*. Posterior pad 205 is preferably crescent-shaped with a cephalad end 205*b* and a caudad end 205*a*. As shown in FIG. 3, the cephalad end 205*b* is preferably wider than the caudad end 205*a*. The posterior pad is arranged along the central line of the sacrum with the caudad end 205*a* terminating proximate the distal end of the coccyx. In a preferred embodiment, posterior support pad 205 is mounted to the vertical member 210*b*, for example, using a collar 215, so as to freely rotate at substantially the same vertical elevation relative to the operating table as the pubic tubercle pad 110. Other means for rotatably mounting these two components are contemplated and within the intended scope of the invention. A fixed end of the vertical member 210*b* is T-shaped and received in a C-shaped track 210*a*, whereby the vertical member is displaceable in an x-direction. A vertical measuring scale (not shown) may be identified on the vertical members 130*b*, 210*b* of the anterior and posterior support mechanisms, respectively, as a guide for adjusting the height of the vertical member 210*b* so that the collar 215 and pubic tubercle pad 110 are at substantially the same elevation relative to the operating table 105.

Figure 4A:
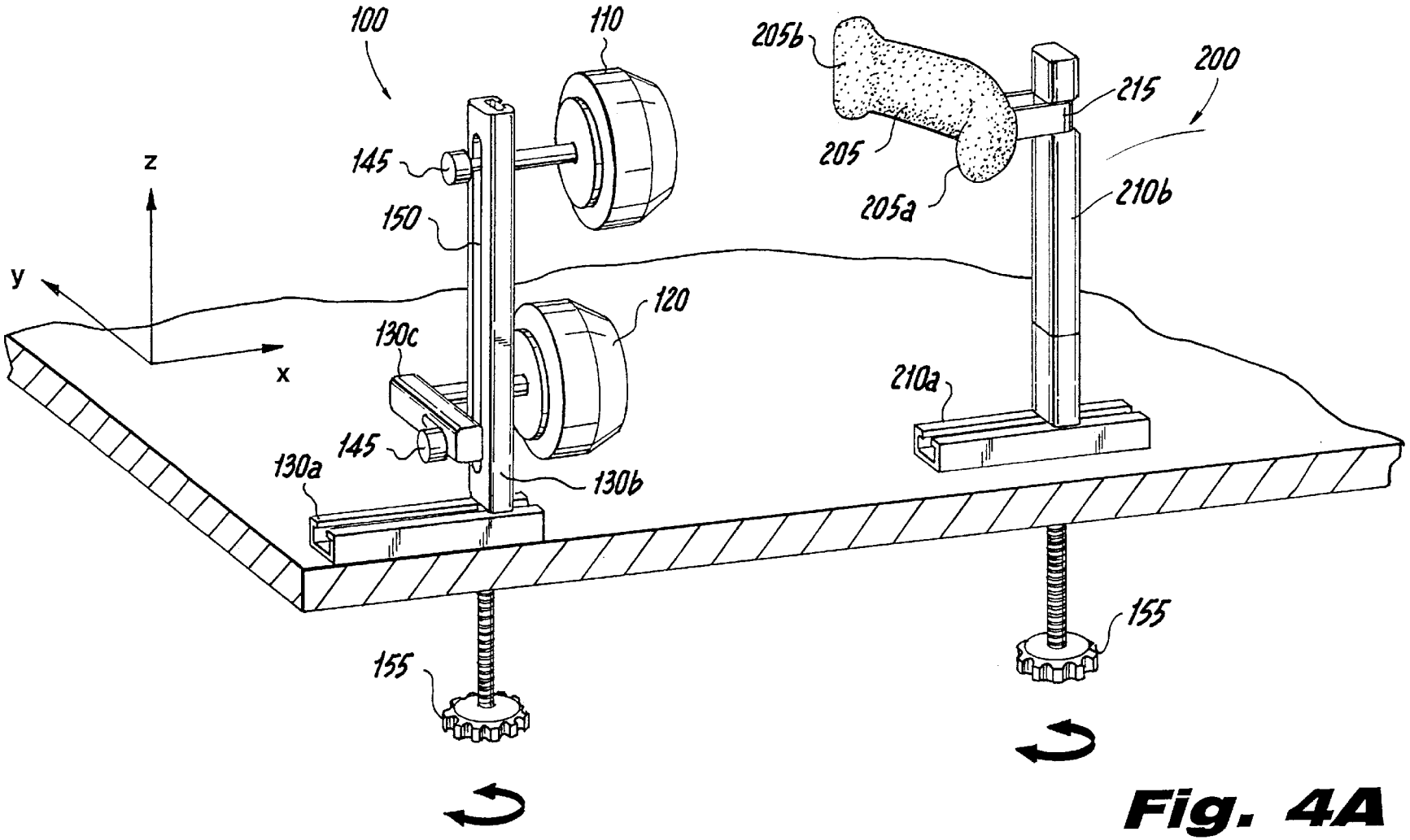
FIG. 4*a* is a first embodiment of a cross section of the operating table to which the anterior and posterior pelvic support mechanisms are mounted using thumb screws for independent movement.

After being properly positioned in the x-direction vertical members 130*b*, 210*b* of the anterior and posterior support mechanisms, respectively, are fixed in position by releasable locking means, preferably disposed beneath the operating table 105. In a first embodiment shown in FIG. 4*a* vertical members 130*b*, 210*b* are independently displaceable along the x-axis and fixed in position by a thumb screw 155 inserted into an elongated slot 150 defined in the closed side of the track 130*a* and the operating table. The free end of the thumb screw is received in a threaded aperture defined in the fixed end of vertical members 130*b*, 210*b*.

Figure 4B:
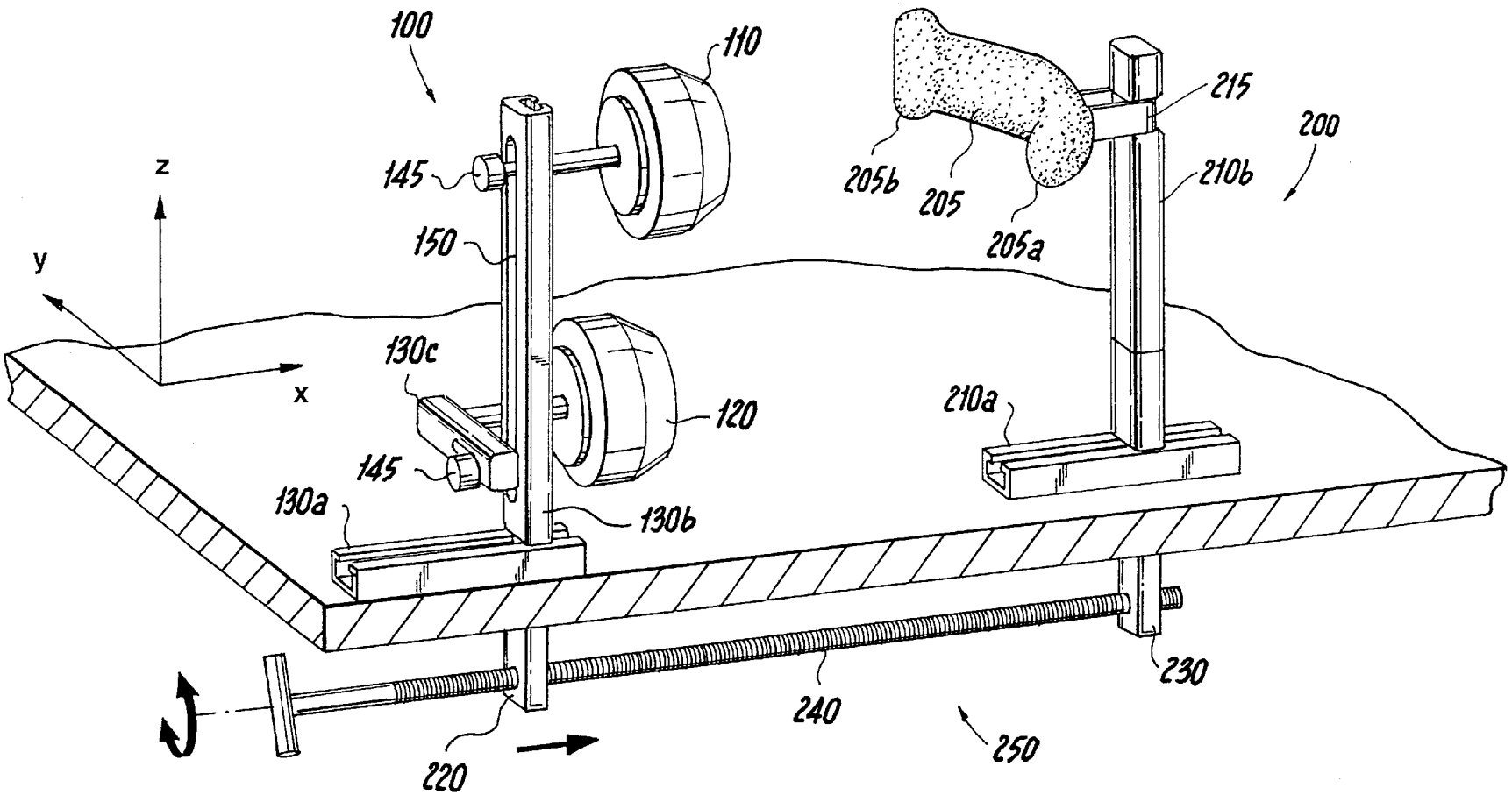
FIG. 4*b* is a second embodiment of a cross section of the operating table to which the anterior and posterior pelvic support mechanisms are mounted using a single threaded rod for simultaneous displacement.

A second embodiment of the releasable locking means is shown in FIG. 4*b*. In this embodiment, the vertical members 130*b*, 210*b* of the anterior and posterior support mechanisms 100, 200, respectively, are displaceable simultaneously along the x-axis (as shown by the arrow) using a single threaded rod assembly 250. Threaded rod assembly 250 is preferably installed beneath the operating table 105 and includes a threaded rod 240 extending through an aperture in base members 220, 230. The base members 220, 230, in turn, are connected to vertical members 130*b*, 210*b*, respectively. As the threaded rod 240 is turned in a first direction, for example, in a clockwise direction, the vertical members are displaced towards one another within tracks 130*a*, 210*a* causing the anterior and posterior pads to contact the patient. On the other hand, when the threaded rod 240 is turned in an opposite direction, such as a counter-clockwise direction, the vertical members are moved away from one another. The simultaneous displacement of the vertical members in this manner is advantageous in that a single technician may properly position the patient without assistance.

Figure 4C:
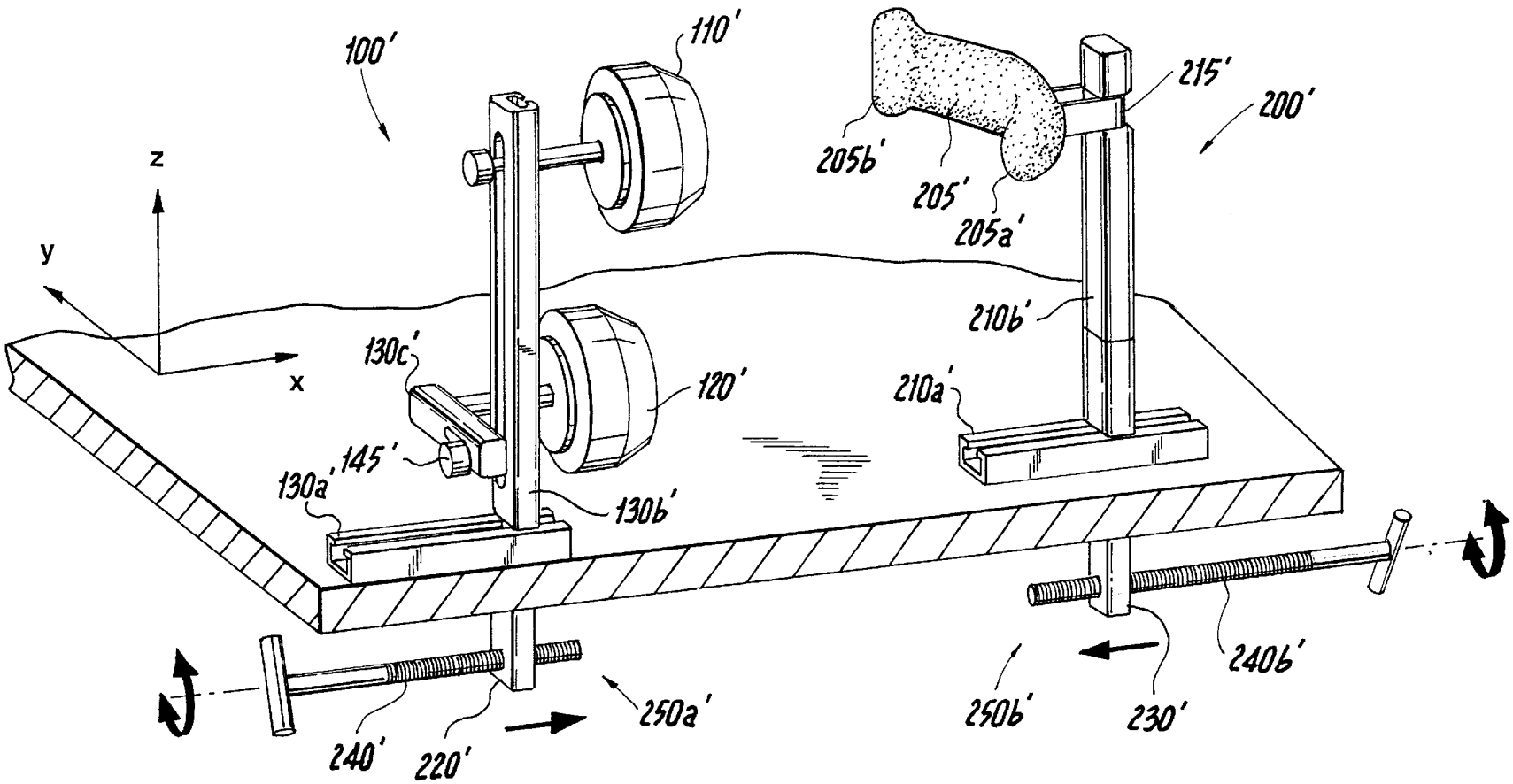
FIG. 4*c* is a third embodiment of a cross section of the operating table to which the anterior and posterior pelvic support mechanisms are mounted for displacement independent of one another using two threaded rods.

In a third embodiment shown in FIG. 4*c*, vertical members 130*b*′, 210*b*′ of the anterior and posterior support assemblies 100, 200 may be displaced along the x-axis (as shown by the arrows) independently of one another. The embodiment shown in FIG. 4*c* is similar to that shown in FIG. 4*b*, except that two threaded rod mechanisms 250*a*′ and 250*b*′ are used to independently control movement of each vertical member. Alternative means for releasably locking the vertical member are contemplated and within the intended scope of the invention, such as a ratchet mechanism.

Although the tracks in the Figures are shown mounted to the upper surface of the operating table, it is also within the intended scope of the invention for the tracks to be recessed and/or mounted to the lower surface of the operating table. Likewise, the releasable locking means for fixing in place the vertical member of the anterior and posterior pelvic support mechanisms may be arranged either on the upper or lower surface of the operating table. Furthermore, other known means for displacably mounting the vertical members to the table may be used instead of tracks.

Figure 6A:
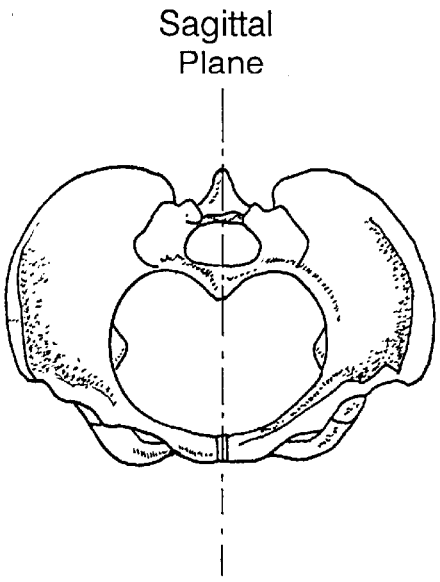
FIG. 6*a* is a view of the pelvis of a body as viewed from the head towards the feet while in a standing position.
Figure 6B:
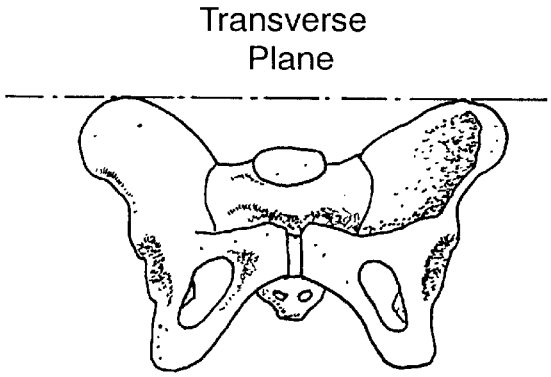
FIG. 6*b* is a front view of the pelvis of a body while in a standing position.
Figure 6C:
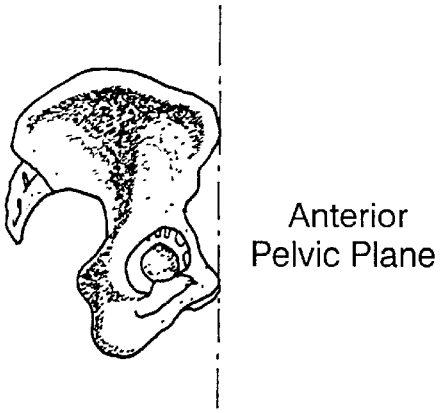
FIG. 6*c* is a side view of the pelvis of a body while in a standing position.

The anterior and posterior support assemblies will constrain the three planes of the pelvis relative to the operating table. The three planes of the pelvis, namely the sagittal plane, the transverse plane, and the anterior pelvic plane are shown in FIGS. 6*a*–*c*, respectively, as defined when the patient is in a standing position. FIG. 6*a* is a view of the pelvis as viewed from the head of the body while in a standing position. The solid line in FIG. 6*a* denotes the sagittal plane. The posterior pad 205 of the positioner device in accordance with the present invention ensures that the patient's sagittal plane remains substantially parallel to the operating table 105. FIG. 6*c* is a side view of the pelvis, in which the solid line represents the anterior pelvic plane as defined by the two ASIS and both pubic tubercles. The position and orientation of the anterior pelvic plane is guided by the anterior pads positioned proximate the two ASIS and the two pubic tubercles. FIG. 6*b* is a front view of the pelvis, wherein the solid line denotes the transverse plane defined by the iliac crest. Positioning the anterior and posterior pelvic support assemblies in accordance with the present invention, ensures that the transverse plane, and thus the patient's body, are substantially perpendicular to the operating table.

In operation, while the patient is positioned lying on the operating table 105 in a lateral decubitus position, the anterior pelvic support mechanism 100 is moved along the x-axis towards the patient's body. Then, pads 120, 140, 110 are positioned both horizontally and vertically so as to be proximate and in contact with the two ASIS and both pubic tubercles. The upper torso pad, if provided, is then horizontally and vertically positioned so as to be in contact with the sternum of the rib cage.

Next, the posterior pelvic support mechanism 200 is drawn toward the patient and the telescopic vertical member 210*b* is adjusted so that the posterior support pad 205 is approximately the same vertical height as the pubic tubercle pad 110. This may be easily accomplished using a vertical measuring scale identified on the vertical members 130*b*, 210*b* of the anterior and posterior pelvic support mechanisms, respectively, or other known means for substantially aligning the two components in a vertical direction. Thereafter, the two vertical members 130*b*, 210*h* are simultaneously or independently drawn closer towards one another thereby securing the patient's body therebetween. Posterior pad 205 rotates freely about vertical member 210*b* and thus, properly positions itself automatically when the posterior pelvic support mechanism is brought into contact with the patient's body. In an alternative embodiment, positioning of the posterior pelvic support mechanism may occur before the anterior pelvic support mechanism.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

What is claimed is:

1. A positioning device for supporting a patient's body in a lateral decubitus position on a table, comprising:

an anterior pelvic support mechanism comprising:

a first anterior support pad positionable so as to support both pubic tubercles of the patient's body; and a second anterior support pad positionable so as to support the anterior superior iliac spine on one side of the patient's body, said first and second anterior support pads being displaceable independently of one another.

2. A positioning device in accordance with claim 1, wherein said first and second anterior support pads each have a concave surface in contact with the patient's body.

3. A positioning device in accordance with claim 1, wherein said anterior pelvic support mechanism further comprises a third anterior support pad substantially aligned with said second anterior pad in a direction substantially perpendicular to a plane defined by a top surface of the table on which the patient's body is positioned.

4. A positioning device in accordance with claim 3, wherein said third anterior support pad is positioned so as to support the anterior superior iliac spine on an opposite side of the patient's body.

5. A positioning device in accordance with claim 1, further comprising a posterior pelvic support mechanism comprising:

a crescent-shaped posterior support pad having a cephalad end and a caudad end, said posterior support pad arranged so as to extend along the sacrum of the patient's body.

6. A positioning device in accordance with claim 5, wherein said caudad end of said posterior support pad terminates proximate a coccyx of the patient's body.

7. A positioning device in accordance with claim 5, wherein said posterior pelvic support mechanism further comprises a vertical member having a fixed end adapted to be mounted to the table and an opposite free end, said posterior support pad being freely rotatable about the free end in a plane substantially parallel with the table.

8. A positioning device in accordance with claim 5, wherein said vertical member comprises telescoping tubes for adjusting the height of said posterior support pad relative to table.

9. A positioning device in accordance with claim 5, wherein said posterior support pad is displaceable in two directions transverse to one another.

10. A positioning device in accordance with claim 5, further comprising means for simultaneously displacing said anterior and posterior support mechanisms, said displacing means connecting said anterior and posterior support mechanisms.

11. A positioning device in accordance with claim 10, wherein said displacing means comprises a threaded rod assembly mounted to said anterior and posterior support mechanisms.

12. A positioning device in accordance with claim 5, further comprising means for displacing said anterior support mechanism and said posterior support mechanism independently of one another.

13. A positioning device in accordance with claim 12, wherein said displacing means comprises a threaded rod assembly mounted to each of said anterior and posterior support mechanisms.

14. A positioning device for supporting a patient's body in a lateral decubitus position on a table, comprising: a crescent-shaped posterior support pad having a cephalad end and a caudad end, wherein said posterior support pad is arranged so as to extend along the sacrum of the patient's body with said caudad end terminating proximate the coccyx of the patient's body.

15. A positioning device in accordance with claim 14, further comprising a vertical member having a fixed end adapted to be mounted to the table and an opposite free end, said posterior support pad being freely rotatable about the free end in a plane substantially parallel with the table.

16. A positioning device in accordance with claim 15, wherein said vertical member comprises telescoping tubes for adjusting the height of said posterior support pad relative to the table.

17. A positioning device in accordance with claim 14, wherein said posterior support pad is displaceable in two directions.

18. A method for using a pelvic positioning device for supporting a patient in a decubitus position on a table, comprising the step of:

displacing a crescent-shaped posterior support pad having a cephalad end and a caudad end so as to contact a patient's body and extend alone the sacrum with said caudad end terminating proximate the coccyx of the patient's body.

19. A method in accordance with claim 18, further comprising displacing said posterior support pad towards the patient's body, said posterior support pad being freely rotatable about a supporting member so as to automatically be properly positioned along the sacrum upon contacting the patient's body.

* * * * *